US005540153A

United States Patent [19]

Campbell et al.

[11] Patent Number: 5,540,153

[45] Date of Patent: Jul. 30, 1996

[54] EMBOSSER AND METHOD USING SLOT MOUNTED DIE AND IMPRESSION PAD

[75] Inventors: Steven M. Campbell, Mechanicsville; Richard N. Webb, Richmond, both of Va.

[73] Assignee: Philip Morris Incorporated, New York, N.Y.

[21] Appl. No.: 489,919

[22] Filed: Jun. 13, 1995

[51] Int. Cl.[6] ..... B41F 21/00

[52] U.S. Cl. ..... 101/493; 101/216; 101/32; 101/377

[58] Field of Search ..... 101/16, 17, 32, 101/212, 216, 219, 493, 376, 377, 378, 379, 380

[56] References Cited

U.S. PATENT DOCUMENTS

| | | | |
|---|---|---|---|
| 811,776 | 2/1906 | Koehler | 101/377 |
| 1,490,709 | 4/1924 | Pannier, Jr. . | |
| 1,827,550 | 10/1931 | Williams . | |
| 2,147,433 | 2/1939 | Flyler | 101/377 |
| 2,263,893 | 11/1941 | Schulman . | |
| 2,447,030 | 8/1948 | Rosenlof . | |
| 2,757,372 | 7/1956 | Chambon . | |
| 3,097,592 | 7/1963 | Friedman . | |
| 3,230,880 | 1/1966 | Beaver | 101/376 |
| 3,327,369 | 6/1967 | Catlin et al. . | |
| 3,403,621 | 10/1968 | Simson et al. . | |
| 3,532,051 | 10/1970 | Teplitz . | |
| 3,693,545 | 9/1972 | Kondur, Jr. et al. | 101/377 |
| 3,742,370 | 4/1973 | Martin | 101/377 |
| 3,995,555 | 12/1976 | Stewart | 101/493 |
| 4,074,417 | 2/1978 | Pearce et al. . | |
| 4,182,239 | 1/1980 | Timmins et al. . | |
| 4,412,489 | 11/1983 | Duhamel | 101/212 |
| 4,527,472 | 7/1985 | Davison | 101/27 |
| 4,580,492 | 4/1986 | Troyan et al. . | |
| 4,779,437 | 10/1988 | Kubiak . | |

FOREIGN PATENT DOCUMENTS

| | | |
|---|---|---|
| 0139066A1 | 5/1985 | European Pat. Off. . |
| 2356243 | 1/1975 | Germany . |

*Primary Examiner*—Eugene H. Eickholt
*Attorney, Agent, or Firm*—Charles E. B. Glenn; James E. Schardt; Kevin B. Osborne

[57] ABSTRACT

The present invention provides an apparatus and method of embossing a sheet of material with a background pattern together with additional selectable indicia, wherein the method comprises the steps of removably securing an indicia-bearing element to a first one of embossing rollers and removably securing a yieldable element to a second one of embossing rollers, passing the sheet material through the nip of rigid embossing rollers while synchronously moving the embossing rollers so as to impart a background, embossed pattern to a first portion of the sheet material and secondly imparting additional indicia to second portions of the sheet material by repetitively bringing into opposing relationship at the nip the indicia-bearing element and the yieldable element.

19 Claims, 6 Drawing Sheets

EMBOSSER AND METHOD USING SLOT MOUNTED DIE AND IMPRESSION PAD

FIELD OF INVENTION

The present invention relates generally to embossing and more specifically to methods of embossing and embossing apparatus that include changeable indicia such as print-characters that encode product information.

BACKGROUND OF THE INVENTION

In the course of producing hinge-lid packs of cigarettes, discrete bundles cigarettes of a predetermined number (usually 20) are wrapped in a piece of paper/aluminum laminate, which is referred to in the art as "foil". In some of the more preferred brands, the foil is embossed with a minute pattern of slightly raised pin-points, which renders a silk-like surface effect.

Typically, the embossed pattern is imposed upon the foil pieces by passing a continuous strip of foil material through a pair of steel rollers, one of which includes minute pins along the substantial entirety of its working surface. These pins intermesh with corresponding pin holes (recesses) on a steel backup roller. Examples of embossing rolls of that nature are shown in EPO 139 066 A1 and DT 23 56 243 A1.

As exemplified in U.S. Pat. No. 2,757,372 to Chambon, it has become the practice to first impart the background pattern and then attempt application of printed indicia as may be desired in a subsequent, separate operation.

Typically, and as exemplified in Chambon, the imprinting of printed indicia upon foil is performed by pressing the print indicia against a yielding background surface. In Chambon, raised print indicia on a first hard cylinder is pressed into a yielding lining of a second cylinder, and the step of embossing the background pattern is executed separately with an additional pair of rollers.

SUMMARY OF THE INVENTION

Accordingly, it is an object of the present invention to provide a novel method and apparatus for embossing a background pattern, together with printed indicia, on sheet material such as a foil of cigarette packs at a single manufacturing station.

It is another object of the present invention to provide such an embossing method and apparatus, which does not require a separate station for the application of print indicia.

Still another object of the present invention is to provide a method and apparatus of embossing sheet material such as a foil with print indicia, wherein the nature and/or extent of print indicia may be readily changed.

It is yet another object of the present invention to provide such method and apparatus for embossing sheet material, wherein the risk of tearing the sheet material is minimized.

Still another object of the present invention is to provide a method and apparatus for embossing sheet material wherein an embossed background pattern and print indicia may be imparted to the sheet material at the same workstation, without compromising the quality of either.

These and other objects are achieved with the present invention which provides an apparatus for embossing sheet material with a background pattern together with additional selectable indicia wherein the apparatus comprises first and second rigid rollers arranged to rotate synchronously with one another and defining a nip there between. The first and second rigid rollers include fixed surface patterns which impart an embossed background pattern to a first portion of a continuous strip of sheet material as the latter is passed through the nip. The apparatus further comprises of a pad of resilient material removably secured to a first one of said rollers at a first location and a die removably secured to the second roller at a second location, such that upon synchronous rotation of the first and second rollers, the pad and the die arrive at the nip in opposing relation to one another. This die and the pad cooperate to impart additional, selectable indicia to a second portion of the sheet material as it passes through the nip.

Another aspect of the present invention is to secure the die element to the respective rigid roller with a pair of fastening bolts which are spaced from one another along the longitudinal axis of the rigid roller. The die element is received within an elongate slot in the roller such that only the indicia-bearing portion of the die extends beyond the surface of the roller. The removable pad is mounted upon a pad holder which is removably attached to the other roller in similar fashion. These mounting arrangements facilitate rapid change of these pieces and avoid imparting undesireable marking and tears in the workpiece. The arrangement also accommodates the use of fastening bolts of a size that can bear repetitive application of a torque sufficient to assure positive retention of the die on the roller.

Preferably, the aforementioned pad of resilient material is mounted upon a pad holder, which is secured with a pair of securing bolts as previously described.

A further aspect of the present invention is to provide plurality of selectable dies held in a single holder which is securable to the rigid roller as described above. The individual dies are retained for purposes of installation by a set screw accessable from one end of the die holder. However, the fit between the holder and each die is such that during installation, the bottom portions of each die is urged against a bottom surface of the slot in the roller upon tightening of the fastening bolts. As a result, the positioning of the dies upon the roller may be precisely controlled.

Preferably, the aforementioned pad of resilient material is mounted upon a pad holder, which is secured with a pair of securing bolts as previously described.

A further aspect of the present invention is provision that the die holder and the pad holder are received in the slots of the respective rollers such that only the die-face and the opposing pad contact the sheet material in that immediate region of the nip so that the preselected indicia provided by the dies are surrounded by a plain background field if desired.

The present invention also provides a method of embossing a sheet of material with a background pattern together with additional selectable indicia, wherein the method comprises the steps of removably securing an indicia-bearing element to a first one of rigid embossing rollers in a manner as previously described and removably securing a yieldable element to a second one of rigid embossing rollers in a manner as previously described, passing the sheet material through the nip of the rigid embossing rollers while synchronously moving the rigid embossing rollers so as to impart a background, embossed pattern to a first portion of the sheet material and secondly imparting additional indicia to second portions of the sheet material by repetitively bringing into opposing relationship at the nip the indicia-bearing element and the yieldable element.

BRIEF DESCRIPTION OF THE DRAWING

Other objects, advantages and novel features of the present invention will become apparent from the following detailed description of the preferred embodiments when considered in conjunction with the accompanying drawing, wherein.

DETAILED DESCRIPTION

Figure 1:
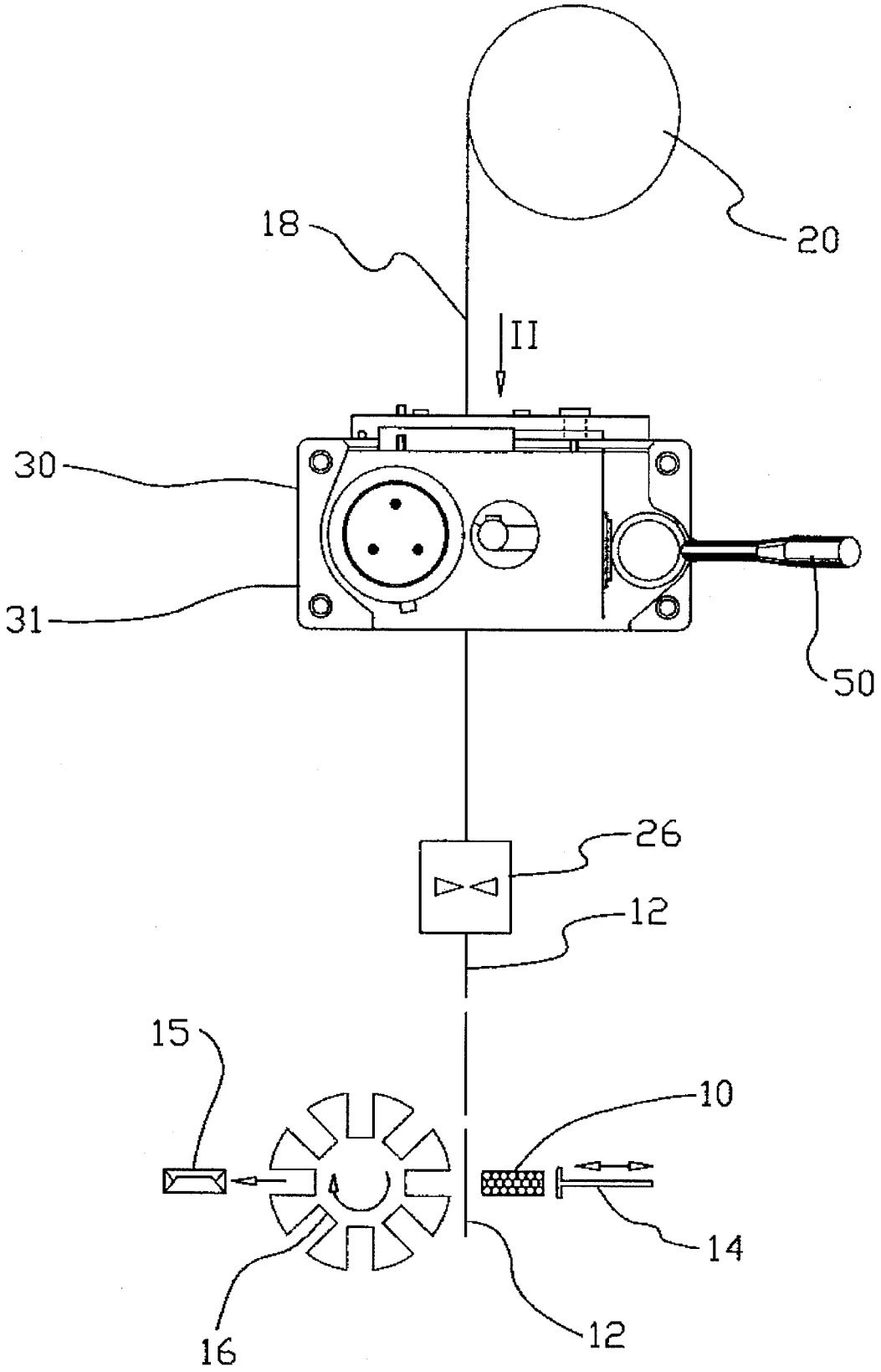
FIG. 1 is a schematic side view of a manufacturing unit comprising a cigarette packer and an embosser apparatus constructed in accordance with a preferred embodiment of the present invention.

Referring to FIG. 1, the process of packing cigarettes into hinge-lid boxes includes a preliminary step of wrapping a bundle of cigarettes 10 in a single piece of paper/aluminum laminate 12, which in the trade is referred to as "foil".

During packing operations, the single piece of foil 12 is positioned between a prepared bundle of cigarettes 10 and a folding wheel 16 of a packing machine, whereupon the plunger 14 urges the bundle of cigarettes into the piece of foil 12 and onto the folding drum 16, whereupon the folding drum moves from station to station to have the foil piece 12 progressively folded about the bundle 10 to produce a folded bundle 15.

Upstream of the plunger station 14, a continuous strip of foil material 18 is drawn from a bobbin 20 and directed through an opposing pair of steel embossing rollers of an embosser apparatus 30 constructed in accordance with a preferred embodiment of the present invention. Downstream of the embosser 30, the strip of foil 18 is cut at a cutter 26 into a succession of individual foil pieces 12.

Figure 2:
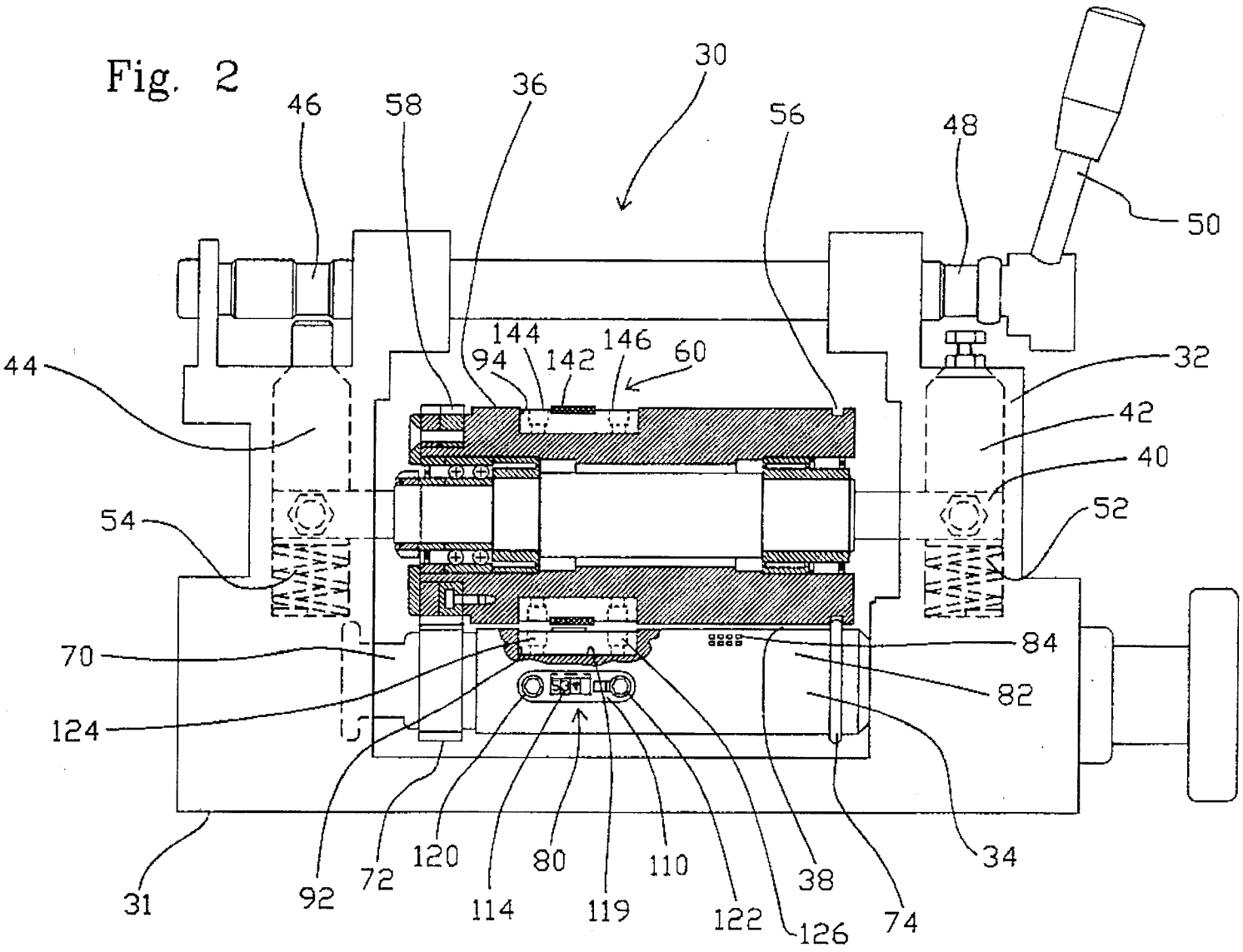
FIG. 2 is a top view of the embosser apparatus as viewed in the direction of arrow II in FIG. 1, which embosser is constructed in accordance with a preferred embodiment of the present invention.

Referring to FIG. 2, the preferred embodiment of the present invention provides an embosser 30 which comprises a housing 32, a driving embossing roller 34 rotatably mounted in a left portion 31 of the housing 32 (as viewed in FIG. 1), a driven embossing roller 36 located immediately alongside the drive roller 34 so as to define a nip 38 therebetween.

The driven roller 36 is rotatably mounted upon an axle member 40, which in turn is affixed to a pair of laterally movable, support members 42 and 44 slideably received within the housing 32. The support members 42 and 44 are movable between a retracted position (shown in FIG. 2) to an operational position by actuation of a pair of cams 46 and 48 upon rotation of an actuator handle 50. Biasing springs 52 and 54 urge the axle member 40 and the driven roller 36 toward the retracted position. Other suitable arrangements for controlling the movement of the support members 42 and 44 would be readily apparent to one of ordinary skill in the pertinent art. For example, pneumatic or hydraulic actuators might be employed to control the movement of the support members 42 and 44.

The driven embossing roller 36 includes an alignment groove 56 at one end thereof and a gear wheel 58 at the opposite end thereof. A plurality of spaced-apart pad assemblies 60 are provided at an intermediate location along the driven embossing roller 36, preferably four pad assemblies 60 at ninety degree (90°) positions about the driven embossing roller 36. It is to be understood that packaging design and/or size might require a different number and/or different angular location of the pad assemblies 60.

The drive embossing roller 34 is connected to drive wheel 70, which in turn may be in drive relation to a source of power through drive belts, gears or other suitable connections. The drive embossing roller 34 includes a second gear wheel 72 which is maintained in meshed relation with the first gear wheel 58 of the driven embossing roller 36. At the opposite end of the drive embossing roller 34, an alignment ring 74 is engaged with alignment groove 56 of the driven roller 36 so as to maintain proper axial relation between the two rollers 34 and 36. At an intermediate position along the drive embossing roller 34 is a plurality of die assemblies 80, each which are removably affixed to the drive embossing roller 34 and located such that they come into alignment directly opposite of one of the pad assemblies 60 at the nip 38.

Figure 3B:
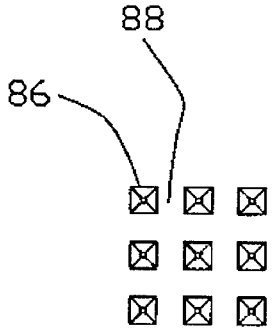
FIG. 3B is a planar view of the pin receiving recesses located along the outer, work surface of the driven roller of the apparatus shown in FIG. 2.
Figure 3A:
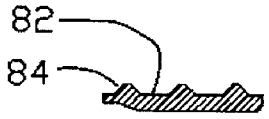
FIG. 3A is a cut-away edge view of the pins located along the outer, work surface of the drive roller of the apparatus shown in FIG. 2.
Figure 5A:
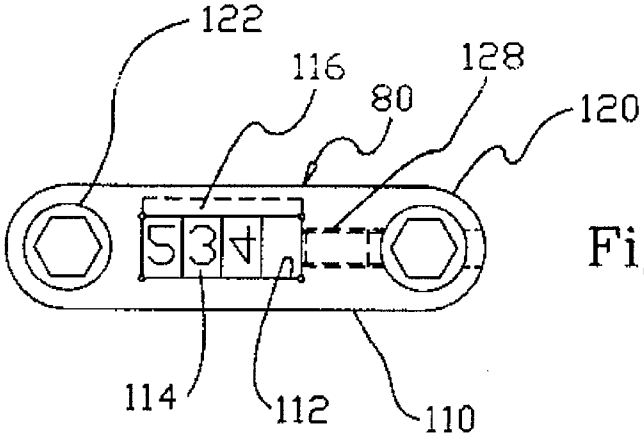
FIG. 5A is a top planar view of a die assembly of the apparatus shown in FIG. 2.
Figure 5B:
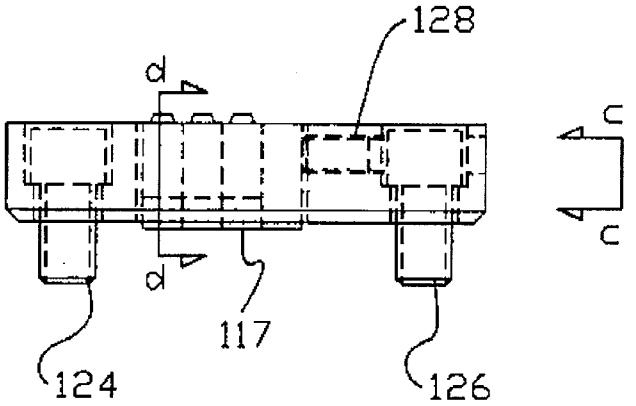
FIG. 5B is a side view of the die assembly shown in FIG. 5A.
Figure 5C:
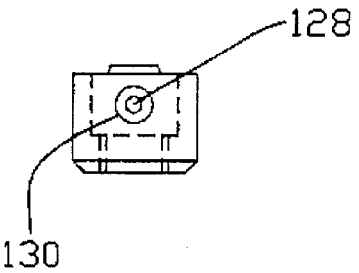
FIG. 5C is an end view of the die holder taken in the direction of arrows c—c in FIG. 5B.
Figure 5D:
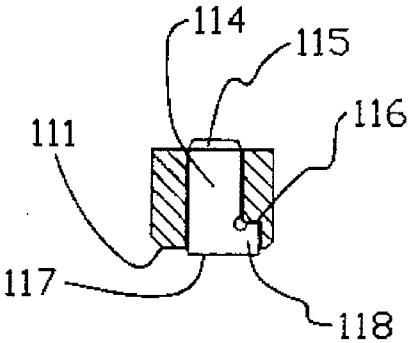
FIG. 5D is a cross-sectional view at line d—d in FIG. 5B.

Referring now to FIGS. 3A and 3B, the cylindrical work-surface 82 of the drive embossing roller 34 includes a host of minute regular protrusions, which in the art is referred to as pins 84. These pins 84 are grouped approximately 60.5 pins per inch in the axial direction of the roller 34 and approximately 65 pins per inch in the circumferential direction. These pins 84 mesh with a corresponding array of recesses 86 formed in the cylindrical work-surface 88 of the driven roller 36.

It is to be understood that the working surfaces 82 and 88 of the embossing rollers do not include the areas subtended by the slots 92 and 94 located about the embossing rollers 34 and 36, respectively, which receive the die assemblies 80 and the pad assemblies 60, respectively.

Figure 4:
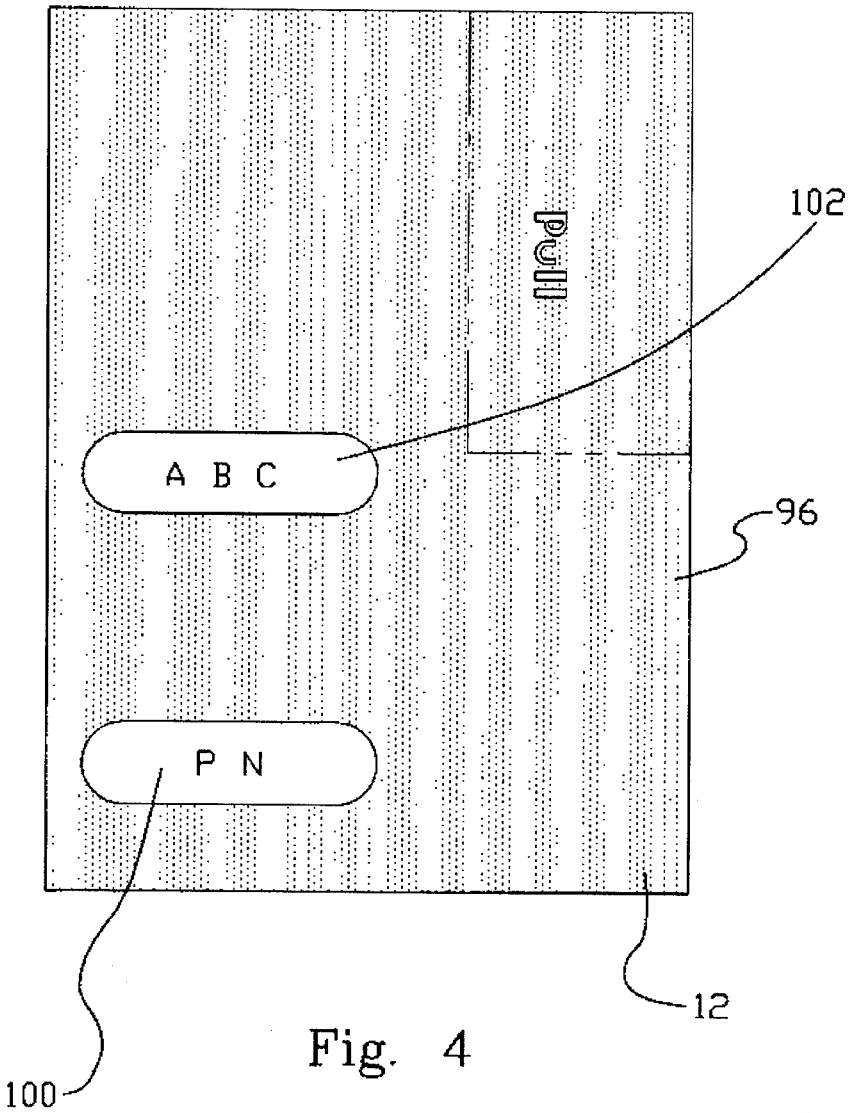
FIG. 4 is a planar view of a foil piece manufactured in accordance with a preferred embodiment of the present invention.

Referring now to FIGS. 3 and 4, in operation, the actuator handle 50 of the embosser 30 is rotated so as to place the driven embossing roller 36 in an operative position adjacent the drive embossing roller 34 such that a force of approximately five hundred pounds is imposed upon foil being passed through the nip 38 of embosser 30. Once the continuous strip of foil has passed through the nip 38 and has been cut into individual foil pieces 12, a first portion 96 of its surface is provided an embossed silk-like appearance by the action of pins 84 and the recesses 86 of the embossing rollers 34 and 36. At locations 100 and 102, the foil piece 12 is provided with impression from the dies 104 of the die assembly 80 by action of one or more of the die assemblies 80 and pad assemblies 60 of the embossing rollers 34 and 36. The information provided therein may pertain to date of manufacture, brand type or other preselected bits of information. The slots 92 and 94 leave blank (smooth) areas of foil immediately about the impressions made by the die assemblies 80, which provides better definition to the indicia.

Referring now to FIGS. 5A–E, each die assembly 80 preferably comprises a die holder 110 having an open slot 112 for receiving a plurality of individual dies 114. At a lower portion along one side of the slot 112 is a recess 116 adapted to receive a toe 118 of each die 114. Such arrangement prevents an inverted placement of a die within the holder 110. The relative depths of the recess 116 and the height of the toe 118 are selected such that each die 114 protrudes by a small and exact amount beyond the bottom surface 111 of the holder 110, preferably by approximately one thousandth of an inch (0.001"). These relationships maintain a tight and exact fit of each die within the slot 112 and clamps the bottom surface 117 of each die 114 positively against the bottom surface 119 of each slot 92 when the bolts 124 and 126 are tightened. Such arrangement provides a positive and precise retention of the dies 114 on the roller 34.

The holder 110 includes screw holes 120 and 122 at opposite end portions thereof so as to accommodate the attachment of the die assembly 80 to the drive roller 34 by the pair bolts 124 and 126. Preferably, the die holder is sufficiently large to accommodate M5 bolts (5 mm thread diameter) or larger so that the bolts can be set with sufficient torque to assure positive retention of the die holder, without risk of fracturing the bolt head. A setscrew 128 retains the dies 114 in position within the holder 110 during installation of the die assembly 80 and is accessible through a hole 130 upon removal of the bolt 126. However, the main clamping force which secures the dies 114 to the drive roller 34 during its operation is provided by the tightening of the bolts 124 and 126, which clamps the toe 118 of each die 114 between the recess 116 of the holder 110 and the bottom surface 119 of the slot 92 in the drive roller 34.

Figure 5E:
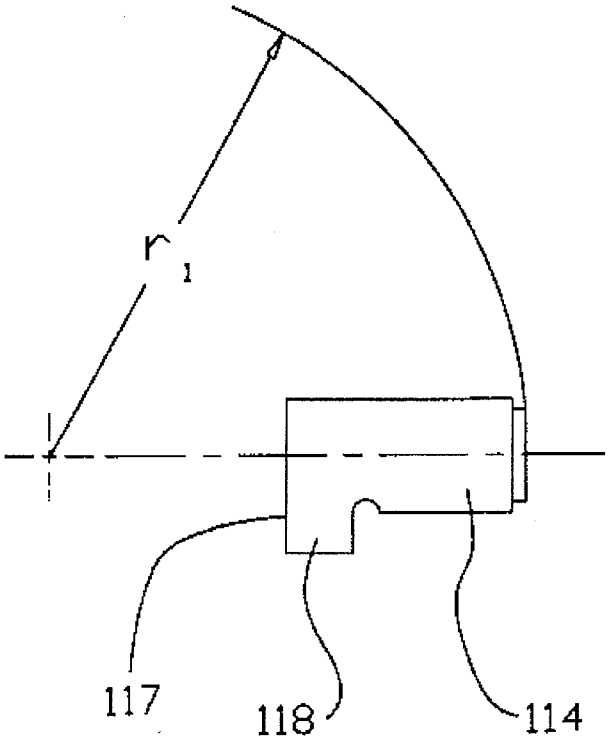
FIG. 5E is a detailed side view of an individual die piece of the die assembly shown in FIG. 5A.

Referring to FIG. 5E, the type-face 132 of each die 114 is preferably radiused by an amount $r_1$ approximating the radius of the drive embossing roller 34.

Figure 6A:
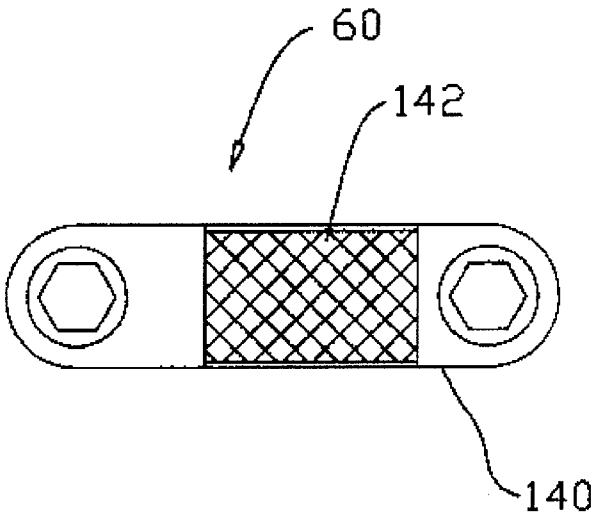
FIG. 6A is a top planar view of the pad and pad holder of the apparatus shown in FIG. 2.
Figure 6B:
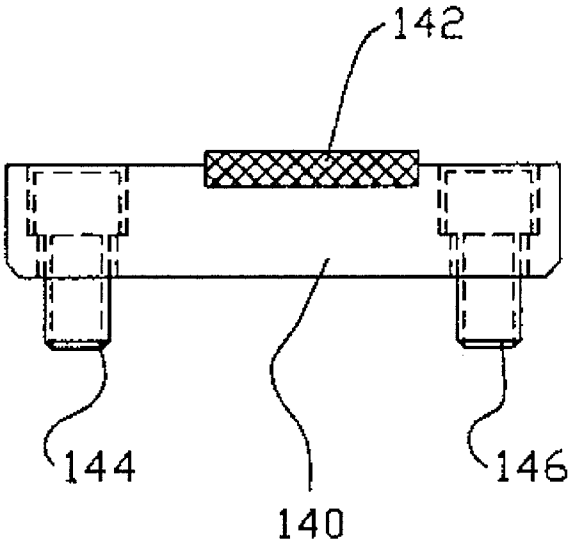
FIG. 6B is a side view of the pad and pad holder shown in FIG. 6A.
Figure 6C:
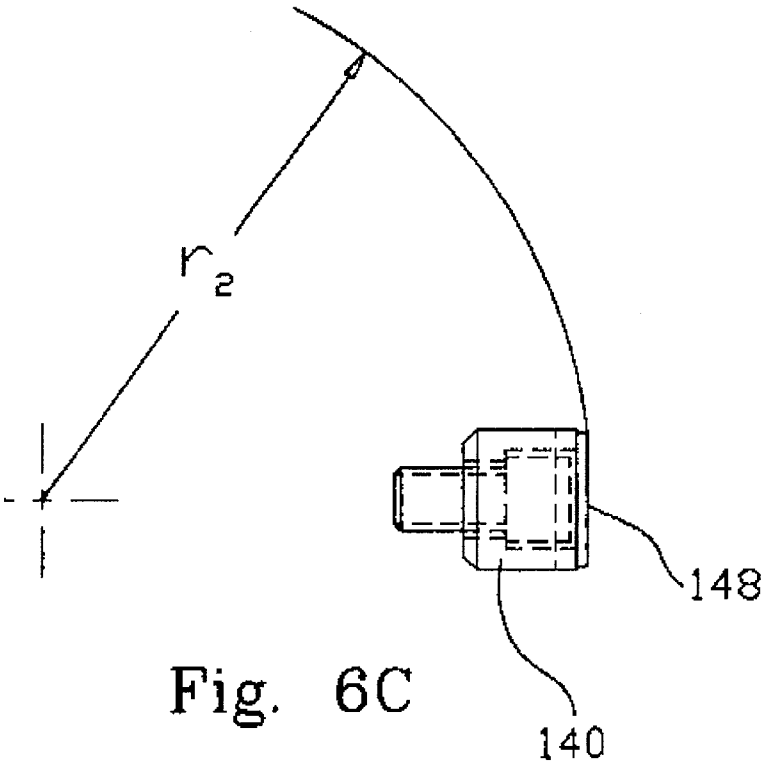
FIG. 6C is an end view of the pad and pad holder shown in FIG. 6A.

Referring now to FIGS. 6A–C, each pad assembly 60 comprises a pad holder 140 and a yieldable pad 142 affixed thereto at a central upper portion of the holder 140. A pair of bolts 144 and 146 (preferably M5 or larger) affix opposite end portions of the pad assembly 160 to the driven embossing roller 36. The bearing face 148 of the pad 142 is preferably radiused by an amount $r_2$ so as to approximately conform with the radius of the driven embossing roller 36.

The yieldable pad 142 is preferably constructed from 90 durometer, Shore A rubber and is preferably approximately ⅛ inch thick or thinner if possible. A host of equally suitable materials could be used instead of the aforementioned rubber for the composition of the yieldable pad 142. Both holders 140 of the pad assembly and 110 of the die assembly are constructed preferably from hardened tool steel as are each of the dies 114.

In the manufacture of the drive embossing roller 34 and the driven embossing roller 36, the pins 84 and recesses 86 are formed using known engraving techniques which result in exact meshing between such elements. The rollers 34 and 36 are constructed from tool steel and through-hardened by heat treatment. Generally, AISI Type A6 toolsteel may be used; however, a Vega toolsteel from the Carpenter Steel Division of the Carpenter Technology Corporation of Redding Pa. is preferred.

Preferably, the slots 92 and 94 are formed in the rollers 34 and 36, respectively, prior to the through-hardening of the rollers 34 and 36, with the depth of the slots 92 and 94 being established as accurately as possible, with allowances being made for changes in depth due to known and/or experimentally determinable volumetric changes in the rollers 34 and 36 as a result of the through-hardening heat treatment.

Referring again to FIG. 2, the depth of each slot 92 is greater than the height of the die holder 110 so that the upper surface of the die holder is slightly recessed from the working surface 82 of the drive embossing roller 34. A similar relationship exists with respect to the depth of the slots 94 and the height of the pad holders 140. Precise control of the total height: of each die piece 114 and its snug fit and retention within the die holder 110, together precise control of the depth of the slots 92 during the manufacture of the roller 34 assure that the raised, indicia bearing portion 115 of each die 114 is situated within a closely controlled amount above the work surface 82 of the drive embossing roller 34, preferably in the range of approximately 2 to 6 thousands of an inch (0.002 to 0.006").

Likewise, the depth of the slots 94 in the driven roller 36 is manufactured precisely so that the bearing surface 148 of the yieldable pad 142 is either flush with the work surface 88 or protrudes only slightly above the work surface 88 (by approximately one thousandth of an inch).

In operation, start up may initiate with having the embosser 30 placed in condition as shown in FIG. 2, wherein the driven roller 36 is opened and disengaged from intimate contact with the driven roller 34 along the working surfaces 82 and 88. The rollers 34 and 36 remain meshed at gear wheels 58 and 72 at all times so as to maintain their angular alignment respective of one another. Once power has been shut-off, the operator may replace some or all the die assemblies 80 and some or all of the pad assemblies 60 by the simple expedient of removing the bolts associated therewith and inserting new sets. The pad assemblies 60 are usually replaced upon a maintenance schedule based the expected longevity of the pads 142. All bolts are tightened and torqued so as to secure each of the replacement asemblies. A continuous strip of foil 18 is then inserted through the nip 38 and the actuator handle 50 (or air valve or other equivalent) of the embosser 30 is operated to then close the driven roller 36 into full engagement with the drive roller 34. The embosser 30 is then in condition for being brought up to operational speed, whereat the working surfaces 82 and 88 of the rollers 34 and 36 impart the embossed, silk-like background pattern to the foil 18 while the die assemblies 80 in cooperation with the pad assemblies 60 repetitively impart the preselected notation set forth in the collection of dies 114. Advantageously, the area of the foil struck by the dies 114 are struck only once and the surrounding areas are not struck at all so as to provide better contrast and to minimize stray tears and imperfections at or about the indicia printed by the dies 114.

Figure 7:
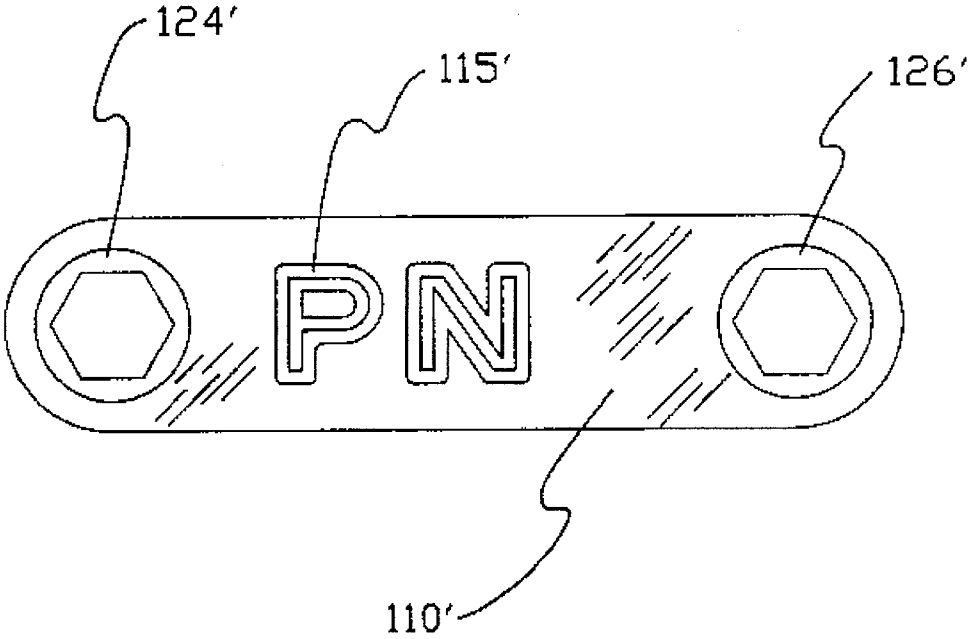
FIG. 7 is a top planar view of a monolithic die element, which is an alternative to the die assembly shown in FIGS. 5A–E.

Referring to FIG. 7, an alternate embodiment of the present invention includes a monolithic die assembly 80', which comprises a die body 110' and one or more raised charachters 115' (or other indicia) integrally formed atop the die body 110'. As with holder-body 110 of the first preferred embodiment, the die body 110' of the monolithic die assembly 80' fits within the confines of a longitudinal slot 92 formed in the drive roller 34 such that only the raised characters 115' protrude beyond the work surface 82 of the drive roller 34. Likewise, the die body 110' is made sufficiently large to receive M5 bolts 124' and 126', so that adequate torque may be applied without risk of separating the bolt head during changeover or during operation of the machine.

It is to be understood that the present invention may be embodied in other specific forms without departing from the spirit or essential characteristics of the present invention. For example, the die assemblies 80 and the pad assemblies 60 could be used on smooth rollers or with other rollers that impart a different surface treatment than do the pins 84 and recesses 86 as described. In such case, the foil or other sheet material would be provided a smooth or different background than as described with the preferred embodiment. Also, the die assemblies 60 could be located upon the driven roller 36 instead of the drive roller 34. It would be readily apparent that all such embodiments would be workable with various sheet materials other than foil, including without limitation paper materials, plastics and various other sheets and laminates.

What is claimed is:

1. A method of simultaneously embossing and encoding a sheet material with selectable indicia, said method comprising the steps of:

removably securing an indicia-bearing elongate element to a first rigid embossing roller by placing said indicia-bearing elongate element in a slot extending longitudinally along said first embossing roller and securing end portions of the placed, indicia-bearing elongate element to said first roller;

removably securing a yieldable element to a second rigid embossing roller by placing said yieldable element in a slot extending longitudinally along said second embossing roller and securing end portions of the placed, yieldable element to said second roller; and passing a strip of sheet material through a nip defined between said rigid embossing rollers while synchronously moving said embossing rollers so as to impart a background treatment to a first portion of said sheet material and to impart additional indicia to a second portion of said sheet material by bringing into opposing relationship at said nip said indicia-bearing element and said yieldable element.

2. The method as claimed in claim 1 further comprising the step of releasably retaining a removable die in a slot of a slotted die-holder body, said step of securing end portions of the placed, indicia-bearing elongate element to said first roller including a step of urging a bottom surface of said releasable die against an adjacent surface of said slot of said first roller.

3. An apparatus adapted to apply a surface treatment to a strip of material together with additional selectable indicia, said apparatus comprising:

first and second rigid rollers arranged to rotate synchronously with one another, said rigid rollers defining a nip therebetween, said first and second rigid rollers cooperating to impart a surface treatment to a first portion of a strip of material as said strip of material passes through said nip during synchronous rotation of said rigid rollers;

a pad of yieldable material removably secured to said first roller at a first location; and a die assembly removably secured to said second roller at a second location such that upon synchronous rotation of said first and second rollers, said pad and said die assembly arrive at said nip in opposing relation to each other;

said die assembly and said pad cooperating to impart indicia to a second portion of said sheet material as said sheet material passes through said nip during synchronous rotation of said rigid rollers;

said die assembly comprising an elongate die body and a raised indicia-bearing portion carried by said elongate die body, said second rigid roller including an elongate slot adapted to receive said elongate die body, said slot oriented longitudinally along a work surface of said second rigid roller, said die assembly including means for removably securing opposite end portions of said elongate die body within said slot of said second roller.

4. The apparatus as claimed in claim 3, wherein said pad of yieldable material is affixed to an elongate pad holder, said first rigid roller including an elongate slot adapted to receive said pad holder, said pad holder including means for removably securing opposite end portions of said pad holder within said slot of said first rigid roller, said slot of said first roller oriented longitudinally along said first rigid roller, said pad of yieldable material being located between said opposite end portions of said pad holder.

5. The apparatus as claimed in claim 4, wherein said pad of yieldable material includes a work surface, said work surface radiused in approximate conformity with a radius of said first rigid roller.

6. The apparatus as claimed in claim 4, wherein said raised indicia-bearing portion includes a type-face that is radiused in approximate conformity with a radius of said second rigid roller.

7. The apparatus as claimed in claim 3, wherein said elongate die body comprises an elongate die-holder body having a holder slot, said raised indicia-bearing portion located on a die disposed in said slot, said elongate die body further comprising means for releasably retaining said die in said holder slot.

8. The apparatus as claimed in claim 7, wherein said holder slot extends through said said elongate die holder-body, said elongate die holder-body including a recess situated along said holder slot, said die including a foot portion which engages said recess such that a bottom portion of said die protrudes from said holder slot below a bottom surface of said elongate die holder-body, whereby upon securing said elongate die holder-body to said second roller, said bottom portion of said die contacts a surface of said elongate slot of said second roller.

9. The apparatus as claimed in claim 4, wherein said first and second rollers emboss a background pattern to said first portion of said strip of material.

10. The apparatus as claimed in claim 4, wherein said elongate die body is received in said slot such that said raised indicia-bearing portion protrudes above said work surface of said second roller and said die body is spaced below said work surface of said second roller.

11. The apparatus as claimed in claim 4, wherein said means for removably securing end portions of said die assembly and means for removably securing end portions of said pad assembly include bolts.

12. The apparatus as claimed in claim 4, wherein said bolts are a size M5 or larger.

13. The apparatus as claimed in claim 7, wherein said first and second rollers are through hardened.

14. The apparatus as claimed in claim 8, wherein said first and second rollers are through hardened.

15. The apparatus as claimed in claim 4, wherein said first and second rollers are through hardened.

16. The apparatus as claimed in claim 4, wherein said raised indicia-bearing portion being located between said opposite end portions

17. The apparatus as claimed in claim 4, wherein said pad of yieldable material being located between said opposite end portions of said pad holder.

18. The apparatus as claimed in claim 4, wherein said elongate die body comprises an elongate die-holder body having a holder slot, said raised indicia-bearing portion located on a die disposed in said holder slot, said elongate die body further comprising means for releasably retaining said die in said holder slot.

19. The apparatus as claimed in claim 18, wherein said holder slot extends through said said elongate die holder-body, said elongate die holder-body including a recess situated along said holder slot, said die including a foot portion which engages said recess such that a bottom portion of said die protrudes from said holder slot below a bottom surface of said elongate die holder-body, whereby upon securing said elongate die holder-body to said second roller, said bottom portion of said die contacts a surface of said elongate slot of said second roller.

* * * * *